United States Patent [19]

Watanabe et al.

[11] 4,166,758

[45] Sep. 4, 1979

[54] METHOD FOR THE PRODUCTION OF A MATTED TRANSPARENT PAPER AND THE PRODUCT THEREOF

[75] Inventors: Noritoshi Watanabe; Masato Nakamura; Seigoro Fujita, all of Motomachi, Japan

[73] Assignee: Kanzaki Paper Manufacturing Co., Ltd., Tokyo, Japan

[21] Appl. No.: 723,137

[22] Filed: Sep. 14, 1976

[30] Foreign Application Priority Data

Sep. 18, 1975 [JP] Japan ..... 50-113176

[51] Int. Cl.[2] ..... D21F 13/00

[52] U.S. Cl. ..... 162/117; 162/141; 162/143; 162/146; 162/150; 162/151; 264/284

[58] Field of Search ..... 162/146, 157 R, 187, 162/206, 362, 117, 141, 143, 150, 151; 427/121; 29/121.8; 264/284

[56] References Cited

U.S. PATENT DOCUMENTS

| | | | |
|---|---|---|---|
| 1,992,996 | 3/1935 | Dodge | 162/187 |
| 3,235,443 | 2/1966 | Greenman et al. | 162/187 |
| 3,412,479 | 11/1968 | Markovic | 29/121.8 |
| 3,486,970 | 12/1969 | Troemel et al. | 162/157 R |
| 3,674,621 | 7/1972 | Miyamoto et al. | 162/146 |
| 3,892,887 | 7/1975 | Shibata et al. | 427/121 |
| 4,015,043 | 3/1977 | Watanabe et al. | 162/146 |

FOREIGN PATENT DOCUMENTS 44-5326 of 1969 Japan .

OTHER PUBLICATIONS

Tappi Data Sheet, "Freeness Scale Interconversion," Corr. 1945.

*Primary Examiner*—Richard V. Fisher
*Assistant Examiner*—Peter Chin
*Attorney, Agent, or Firm*—Armstrong, Nikaido, Marmelstein & Kubovcik

[57] ABSTRACT

A matted transparent paper is obtained by moistening a paper prepared from relatively lightly beaten natural pulp and then subjecting the moistened paper to a calendering treatment with the use of a heated embossing metal roll having a finely engraved surface with sharp reliefs.

8 Claims, 14 Drawing Figures

METHOD FOR THE PRODUCTION OF A MATTED TRANSPARENT PAPER AND THE PRODUCT THEREOF

BACKGROUND OF THE INVENTION

This invention relates to the production of a matted transparent paper which is improved in writability, paper strength, dimensional stability and secondary processability.

A tracing paper, a master copy paper and a paper for plotter are usually required to have a uniform transparency and a good writability with a pencil or an aqueous ink. Those papers have been generally prepared by subjecting papers made of heavily beaten pulp having a Canadian Standard Freeness (hereinafter referred to as CSF) of within the range of 50 to 100 cc or less to a treatment with heat and pressure under a high moisture content with the use of a calender. However, the heavy beating of pulp promotes an injury and a hydration of pulp fibers and the papers made of such heavily beaten pulp have various practical disadvantages such as a low paper strength for example tear resistance and a low dimensional stability to moisture. In addition, a paper sheet treated by for example a heated super calender for the purpose of obtaining a high transparency has a very smooth surface, and accordingly is inferior in a writability.

Japanese Patent Publication No. 5,326 of 1969 discloses a process for making a transparent paper in which natural pulp, synthetic pulp or a mixture thereof is formed into a paper and then heat and pressure are applied to the resultant paper under the condition of the moisture content of the paper being 10 to 30% with the use of a flat plate or a roll having such an uneven surface that its surface roughness, H max, which is defined in Japanese Industrial Standard (hereinafter referred to as JIS) BO601-1955 is within the range of 2 to 20 microns, and a height of the fine relief peak on the surface is within the range of 0.2 to 1 micron. This technique has improved a writability of paper which has never been satisfactorily obtained in the conventional calendering techniques by forming finely uneven structures on the surface of the paper with use of a particular calender system provided with the uneven surface roll. The paper thus obtained has an improved writability, but this technique still depends on the conventional heavily beaten pulp for obtaining a transparency which is one of the other important required characteristics. Since this technique depends on a limited method such as a sand blast method for forming the finely uneven structures on the surface of the roll, the processed surface of the roll is limited to the extremely fine structures having the patterns peculiar to the sand blast method. Therefore, a satisfactory and uniform transparency cannot be obtained when the paper is made of pulp having a CSF larger than 100 cc though it can be obtained in the case of the paper being composed of heavily beaten pulp. The above technique uses, practically, the pulp whose beating degree is within the range of 90 to 95SR according to a Schopper-Riegler method described in JIS P8121. This value of beating degree corresponds to a CSF of one figure value which shows that the pulp is beaten to an extremely high extent. The disadvantages due to such a heavy beating have been already described hereinbefore.

As described above, according to the prior arts, it has never been possible to obtain a tracing paper or a master copy paper superior in a uniformity of transparency, paper strength, writability, dimensional stability and secondary processability with the use of such an ordinarily beaten pulp that is used in making a general wood free paper.

According to the invention, the above described problems in the prior arts can be solved. This invention is based on a discovery which is against the heretofore accepted theory that a heavy beating is required for obtaining a sufficient transparency of sheet. This invention is characterized by that a paper is prepared from ordinarily or lightly beaten pulp and then heat and pressure are applied to the resultant paper with aid of a special embossing metal roll whereby the problem of decrease in transparency inherent in the use of such lightly beaten pulp is solved.

An object of the invention is to provide a matted paper which has a uniform transparency and is improved in writability, paper strength, dimensional stability and secondary processability.

Other objects and advantages of the invention will become apparent from the following descriptions.

SUMMARY OF THE INVENTION

According to the invention, a paper is prepared from an aqueous suspension of pulp having a CSF larger than 100 cc which is composed of natural pulp alone or a mixture of natural pulp and synthetic pulp. The paper thus prepared is moistened so as to have a moisture content within the range of 5 to 30% and then subjected to a calendering treatment with the use of a heated embossing metal roll to transparentize the moistened paper and form a finely embossed surface thereon. The embossing metal roll has a peripheral surface engraved so as to have a surface roughness of a Rmax of 20 to 200 microns and a relief peak number of 1 to 20 per 1 mm.

BRIEF DESCRIPTION OF THE INVENTION

FIG. 1 shows a chart whose vertical and horizontal magnifications are 1600 and 20, respectively, which is obtained by a measurement of the surface roughness of #800 embossing roll which was used in Examples. The measurement was carried out according to JIS BO60-1-1970 and JIS BO651-1970 with the use of a stylus having a radius of curvature of 5 microns at stylus head and with the use of a surface roughness tester SE-4 manufactured by Kosaka Laboratory, Ltd., Japan, and the results were recorded with aid of a self-balancing mono pen type recorder QPD-53 manufactured by Hitachi, Ltd., Japan, in which the available width of recording paper was 250 mm and the balancing rate was less than one second/full scale.

DETAILED DESCRIPTION OF THE INVENTION

Figure 1:
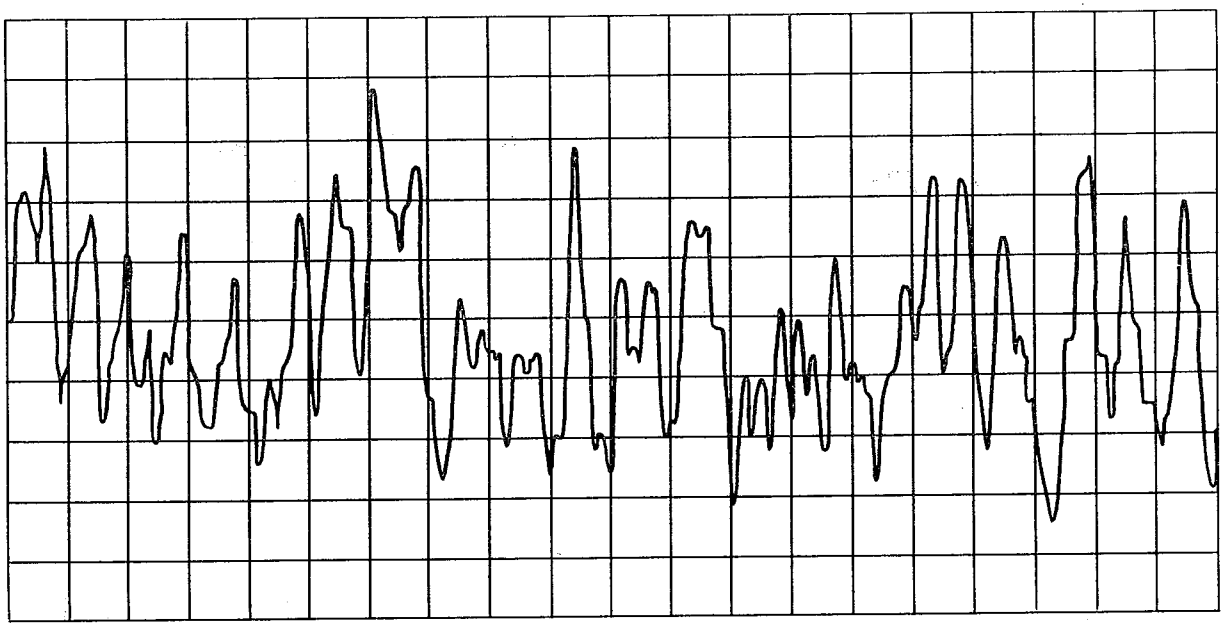
Figure 2:
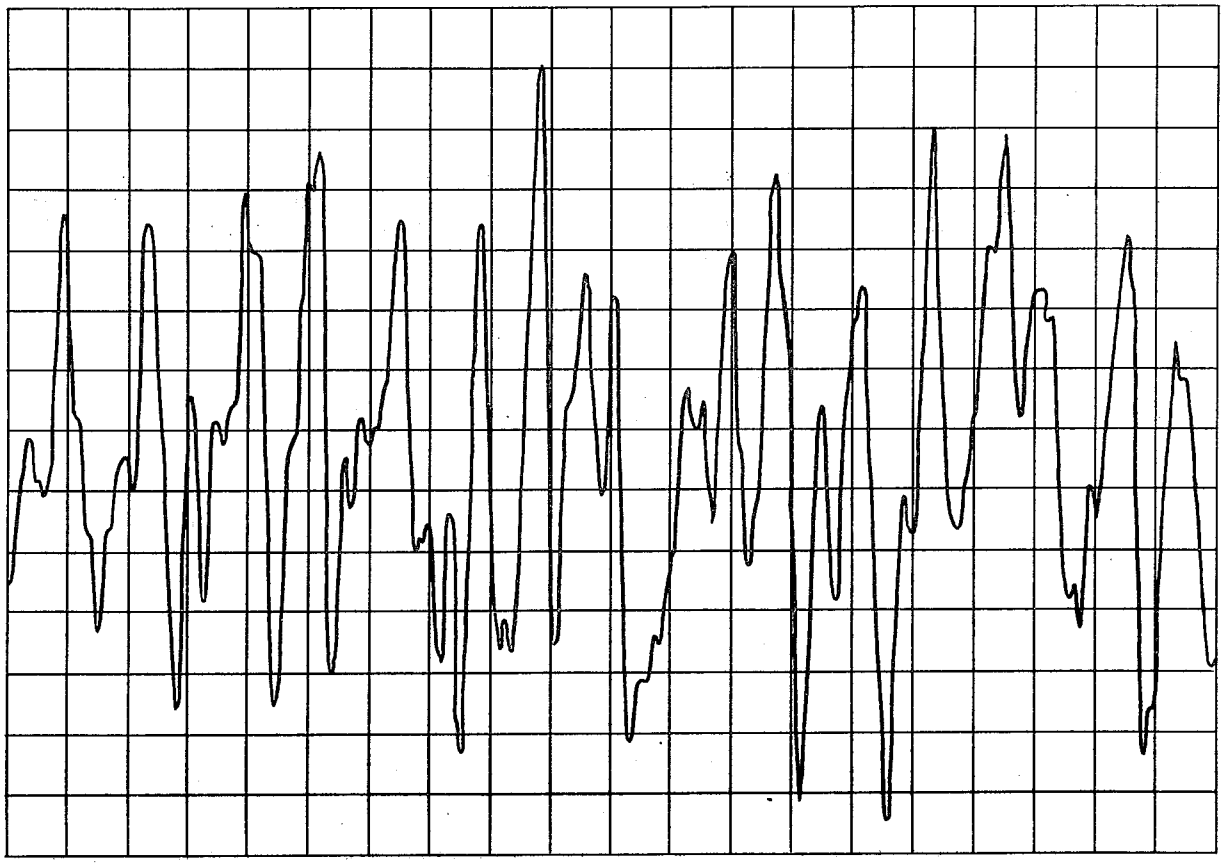
FIG. 2 shows a chart obtained by a measurement of the surface roughness of #400 embossing roll which was used in Examples. The measurement was carried out in the same manner as the above.
Figure 3:
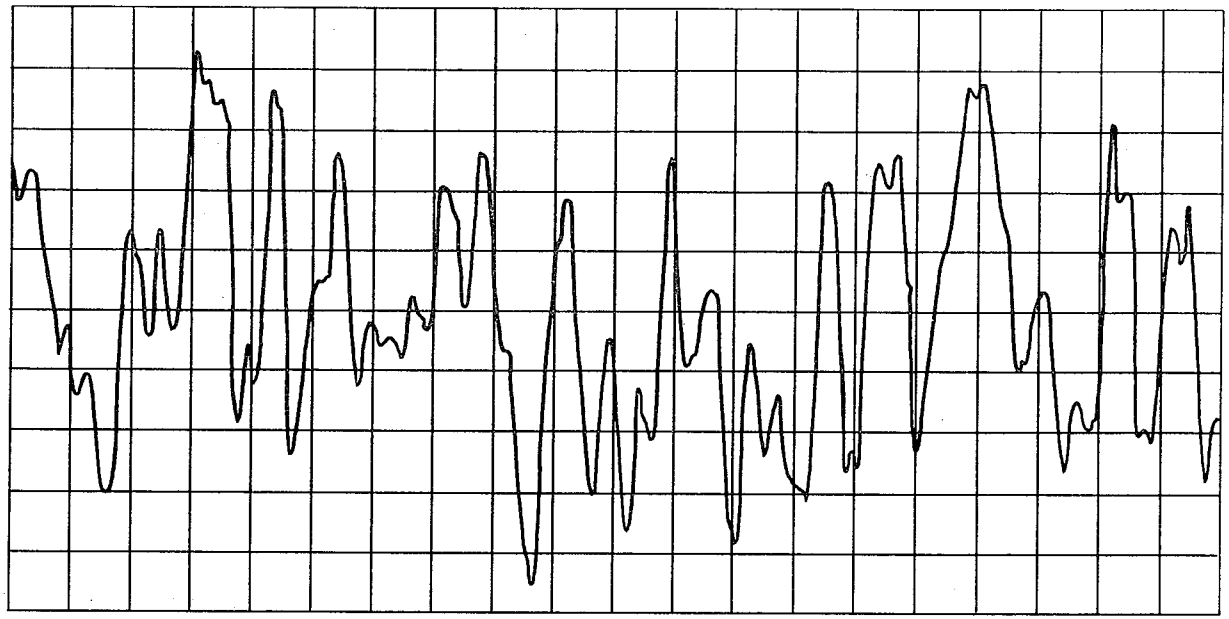
FIG. 3 shows a chart obtained in the same manner as the above with respect to the #300 embossing roll which was used in Examples of the invention, provided that the vertical magnification is 600.
Figure 4:
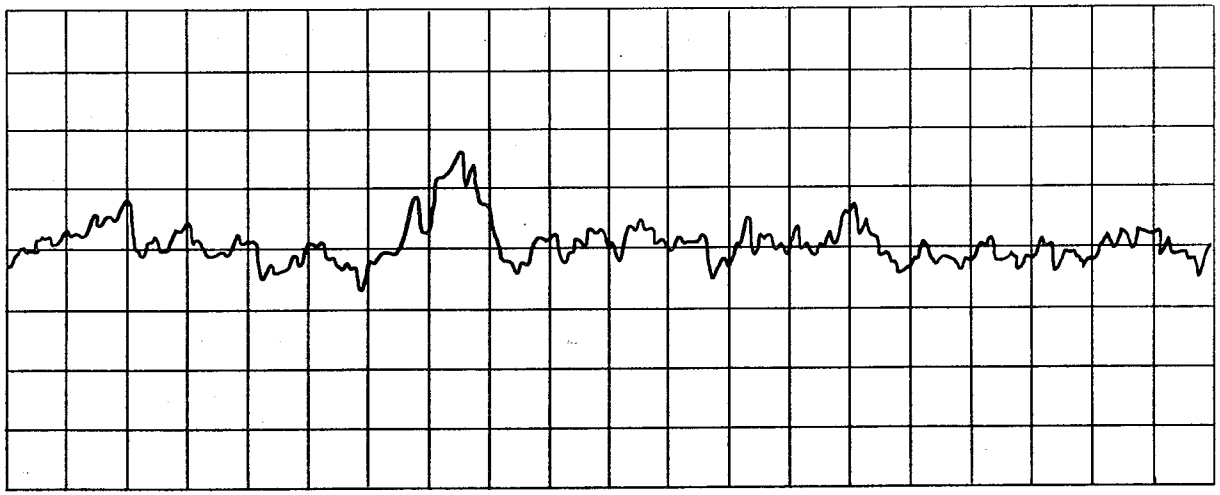
FIG. 4 shows a chart obtained in the same manner as the above with respect to a conventional 46 mesh emery sand blast roll which was used in Controls.

In this invention, it is an essential requirement that the paper used in the invention should be prepared from an aqueous suspension of pulp whose beating degree is larger than 100 cc in CSF and which contains natural pulp alone or a mixture of natural pulp and synthetic pulp. The term of beating degree means that of the pulp suspension in the prior state to paper making. Among the pulp suspension there are included a suspension of beaten virgin pulp, a suspension of disintegrated pulp from waste papers and a mixture thereof. In addition, even if pulp itself has a beating degree out of the range defined in the invention, it may be used provided that the beating degree falls within the range defined upon mixing it with other pulp.

Among the pulp suspensions having beating degree of the specific range described above, that having the beating degree of 150 to 650 cc in CSF is preferable and that having the beating degree of 200 to 600 cc in CSF is the most preferable.

As natural pulp, any kind of natural pulp available for a wet paper making such as wood pulp and the other natural pulp, for example, those prepared from bast fibers, animal fibers and the like may be used. Among them the wood pulp is the most preferable.

As synthetic pulp, any kind of synthetic pulp available for a wet paper making process may be used. For example, such a synthetic pulp is disclosed in Japanese Patent Publications No. 8,565 of 1960, No. 19,602 of 1963, No. 2,302 of 1964, No. 10,183 of 1968 and No. 32,458 of 1971, Japanese Laid-Open Patent Publications No. 35,319 of 1972, No. 35,225 of 1972, No. 29,820 of 1975, No. 36,731 of 1975 and No. 40,803 of 1975. In this invention, the synthetic pulp is used in the form of a mixture with natural pulp. The mixture ratio by weight of natural pulp to synthetic pulp should be within the range of 100:0 to 10:90. It is not desirable to use the synthetic pulp alone for making a paper because the paper prepared from synthetic pulp alone changes into a film by heat and pressure of this invention.

The conventional additives such as sizing agents; fixing agents; releasing agents; fillers, dyestuffs; adhesives such as starch, polyvinyl alcohol, carboxy methyl cellulose, sodium alginate and aqueous solutions or emulsions of synthetic resins or polymers; transparentizing agents; transparentizing assistants; and antistatic agents may be used in the process of paper making.

A paper prepared from the pulp suspension having the beating degree described above with the use of a conventional paper machine such as a Fourdrinier paper machine and a cylinder paper machine has various difficulties in the transparentization of paper. The lightly beaten pulp much differs in its fiber structure from the heavily beaten pulp. In case of lightly beaten natural pulp, the fibers are not so much injured but remain a rigid spindle form and accordingly a number of intercellular spaces remain in the fibers. Therefore, the paper prepared from such natural pulp shows a high resistivity against transparentization by an application of heat and pressure. Similarly, the light beaten synthetic pulp has a rigid rod-like spindle or random structure which gives a high resistivity against transparentization. Furthermore, such a lightly beaten pulp forms a loose paper layer because the lightly beaten pulp fibers have a relatively large diameter, for example, within the range of 10 to 30 microns and a relatively long fiber length, for example, within the range of 1 to 3 mm, which raises difficulties in transparentizing by the application of moisture, heat and pressure. Since the lightly beaten pulp is superior in a drainage in a wire part of paper machine to the heavily beaten pulp, a paper making rate is increased. However, the lightly beaten pulp additionally tends to give wire marks on the surface of the resultant paper which cause an undesirable effect on the uniform transparentization of the resultant paper together with other factors such as felt marks formed in a press part and wrinkles and cocklings formed in a dryer part which concern with the surface structure of paper.

According to the invention, the above mentioned disadvantages inherent in the use of such a lightly beaten pulp can be avoided by utilizing a special embossing metal roll.

As the embossing metal roll of the invention, there may be used a metal roll having such a finely rugged surface that Rmax is within the range of 20 to 200 microns, preferably 25 to 160 microns, and a relief peak number is within the range of 1 to 20 per 1 mm, preferably 2 to 15 per 1 mm. A definition of the term of Rmax is as follows. According to JIS BO601-1970 and JIS BO651-1970, the roll surface is scanned with a stylus having a radius of curvature of 5 microns at the stylus head of under the conditions of a stylus pressure of 0.4 g and a scanning velocity of 0.2 mm/sec. to obtain a chart. A straight line which contacts with three peaks with exception of the highest peak on the thus obtained chart is drawn as a standard line. A distance from the standard line to the deepest bottom of the curve which exists in a region to which the standard line belongs is defined as Rmax. When the value of Rmax is out of the range defined herein, a paper having a good balance of quality cannot be obtained. In addition, it is not preferable to use such a roll whose Rmax is beyond the range defined in the present invention because it is liable to injure an elastic roll which is used in combination with the embossing roll in order to form a nip.

The term of "relief peak number" refers to the number of peaks per 1 mm of scanning distance on the same chart obtained in the above mentioned measurement of Rmax. Upon the calculation of the relief peak number, extremely low peaks, i.e., those having a hight less than 5% of Rmax, should be neglected. Each of Rmax and the relief peak number represents an arithmetic means value of randomly selected respective ten results of measurements. Each of the relief peaks may preferably be sharp. When the value of the relief peak number is out of the range of 1 to 20 per 1 mm, it would be impossible to obtain a paper having a uniform transparence and a desired surface roughness.

Among methods for manufacturing the above mentioned embossing roll, an engraving method in which the patterns engraved on a mother roll are reproduced on the surface of the metal roll is the most preferable. The particular uneven surface structures may contribute to enhancing a microscopic linear pressure effect of the roll, a heat transfer effect and a removing effect of air and moisture from the paper layer. Therefore, a uniform transparency can be obtained even on such a paper that has a large interfibrous space therein or an appreciable wire mark or that is inferior in a thermoplasticity.

On the contrary, when an embossing metal roll prepared by a conventional sand blast method is used, the pressure may be applied to the paper rather in a state of surface pressure from a microscopic viewpoint and accordingly the pressure may not be sufficiently applied to such a part of the paper in which the interfibrous spaces and the wire marks exist. Consequently, a uniform transparency cannot be obtained. The resultant paper has a number of misty opaque spots.

This invention does not intend to limit the material for the embossing metal roll; but metal roll made of cast iron, alloys including nickel and/or chrome, or steel and rolls whose surface is plated with hard chrome are preferably used. The embossing metal roll may also be provided with an internal heating or cooling device therein.

In the present invention, a good matted paper may be obtained even when the moisture content of the paper upon passing through a nip of the embossing metal roll is relatively low, i.e., within the range of 5 to 30%, preferably 7 to 27%. Generally, the moisture contained in paper serves as a plasticizer for pulp, a heat transfer medium, or a remover of air contained in the paper to make speedily it transparent. However, according to the invention, it is possible to attain a sufficient transparentization even when the moisture content is relatively low because the particular embossing metal roll of the invention contributes immensely to enhancing the transparentization. Especially, when a synthetic pulp is used for making a paper, the desired results may be obtained in a lower region of moisture content of the paper because the synthetic pulp is mainly composed of thermoplastic polymer and has an extremely low content of equilibrium moisture. As a method for moistening the paper until the moisture content falls within the range described hereinbefore, there may be used a conventional moistening method such as a coating method with use of a conventional coating means, a spraying method and an electrostatic moistening method. In the process of moistening paper, the various additives such as sizing agents, releasing agents, antistatic agents, transparentizing agents and dyestuffs may be added into water.

In the industrial practice of the invention, the embossing metal roll is used for the treatment of the paper in an embossing or calendering system. Fundamentally, a single nip emboss of machine consisting an embossing metal roll and an elastic roll which are contact under pressure to each other may be used. In case of a multistack super calendering system having a plurality of nips at least one of chilled rolls may be replaced by the embossing metal roll according to the invention. This invention does not intend to limit the material for the elastic roll and its hardness, but cotton, paper, asbestos, synthetic fibers for fiber roll and hard rubber are desirably used as a material. Referring to the hardness of the elastic roll, one having a shore hardness not less than 70° is preferable.

The temperature of the embossing metal roll should not be limited to a specific range but is determined depending upon the various factors such as moisture content, pulp composition, weight of paper and number of nip. When a multiplicity of the embossing rolls is used, each roll may be at the different temperatures. However, it may be generally within the range of 50° to 200° C., preferably 80° to 180° C.

The pressure to be applied on the paper is not limited as well. In case of treating a paper comprising synthetic pulp having a low softening point, the pressure may be relatively low. When the paper comprises a large quantity of natural pulp, a relatively high pressure is preferably applied. Generally, the pressure may be controlled within the range of 20 to 600 kg/cm, preferably 40 to 400 kg/cm.

The matted paper obtained according to the invention has a uniform transparency without any misty opaque spot inherent in the use of lightly beaten pulp and has an excellent writability. In addition, since a paper prepared from lightly beaten pulp is used as a base sheet in the invention, the resultant matted paper has an excellent dimensional stability to moisture or water and accordingly it further has an excellent secondary processability, for example, an excellent printability, printing workability in offset printing and coating workability of an aqueous coating composition compared with a conventional transparent paper. The matted paper of the invention is suitable for various base papers such as a base paper for pressure sensitive copying paper, releasing paper and etc.

The invention will be further illustrated by reference to the following examples, however, the invention is not limited to those examples but includes wide variations.

Unless otherwise indicated, parts and % signify parts by weight and % by weight, respectively.

EXAMPLE 1

Figure 13:
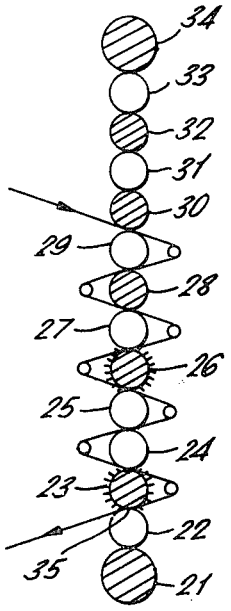
FIG. 13 is a schematic elevational view of a super calender used in Example 1.

A paper was made from a pulp suspension having a CSF of 400 cc prepared from 20 parts of a bleached needle-leaved kraft pulp (N) having a CSF of 380 cc and 80 parts of a bleached broad-leaved kraft pulp (L) having a CSF of 450 cc with the use of a Fourdrinier paper machine. The moisture content of the resultant paper was adjusted to 23% by applying water to the sheet with a spray nozzle moistner. Then the sheet was passed through a fourteen stacks super calender in such a manner as shown in FIG. 13 so that both surfaces of the sheet might be subjected to the treatment with the embossing roll for two times. In FIG. 13 the fourteen stacks super calender was provided with two embossing rolls (23,26) plated with hard chromium and having a surface engraved so as to have Rmax of 34.3 microns and a relief peak number of 8 per 1 mm (hereinafter referred to as #800 embossing roll) at the third and sixth position from the bottom and also having conventional chilled rolls (21, 28, 30, 32, 34) and elastic rolls (22, 24, 25, 27, 29, 31, 33). The surface temperatures of the third roll (23) and sixth roll (26) were 155° C. and 145° C., respectively. The maximum linear pressure of the final nip (35) was 220 kg/cm and the passing velocity of the paper was 50 m/min.

Control 1

Example 1 was repeated except that the two #800 embossing rolls were replaced with two chilled rolls having smooth surfaces.

Figure 5:
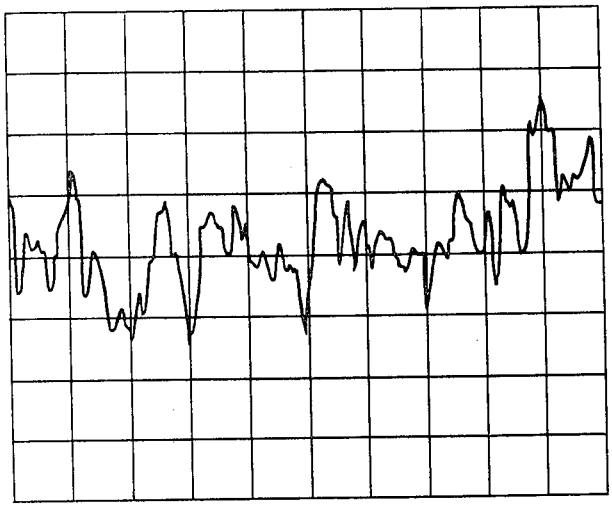
FIG. 5 shows a chart obtained in the same manner as the above with respect to a matted transparent paper obtained in Example 1.
Figure 6:
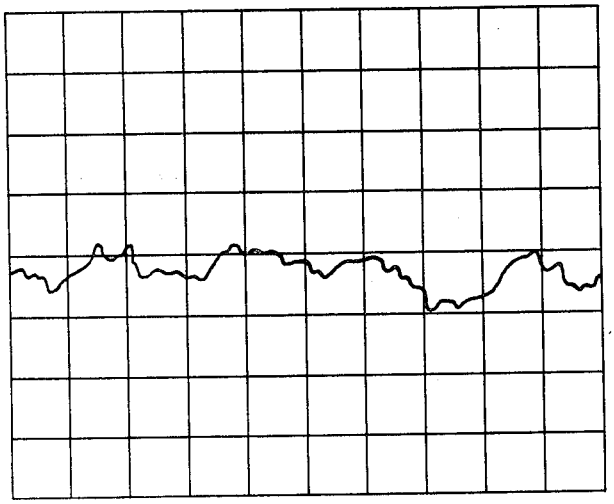
FIG. 6 shows a chart obtained in the same manner as the above with respect to a matted transparent paper obtained in Control 1.
Figure 7:
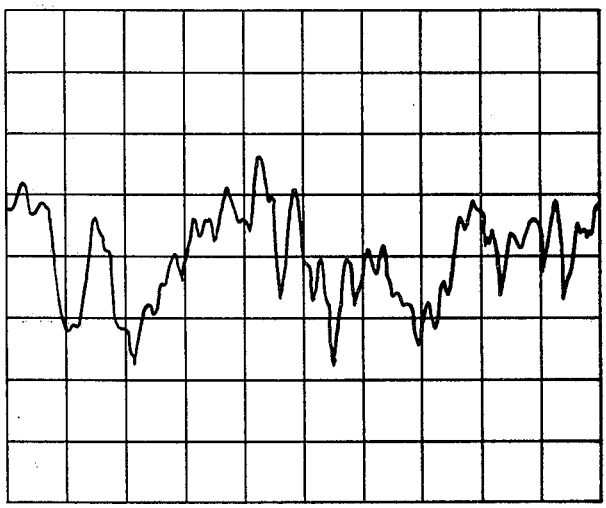
FIG. 7 shows a chart obtained in the same manner as the above with respect to a matted transparent paper obtained in Example 3-1.
Figure 8:
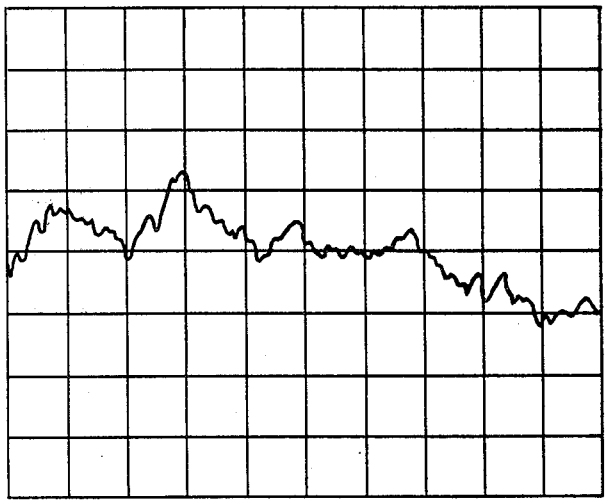
FIG. 8 shows a chart obtained in the same manner as the above with respect to a matted transparent paper obtained in Control 2-1.
Figure 10:
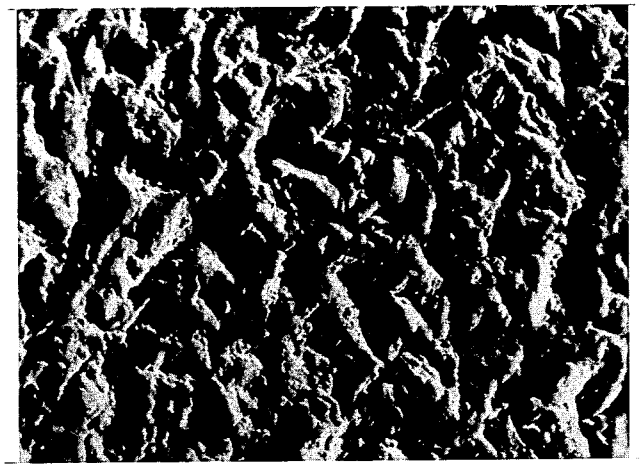
FIG. 10 shows a photograph obtained in the same manner as the above with respect to #400 embossing roll which was used in Examples of the invention.
Figure 12:
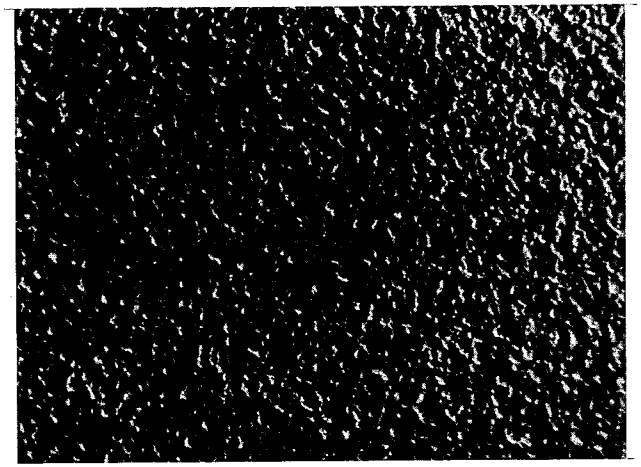
FIG. 12 shows a photograph obtained in the same manner as the above with respect to 46 mesh emery sand blast roll which was used in Controls.
Figure 9:
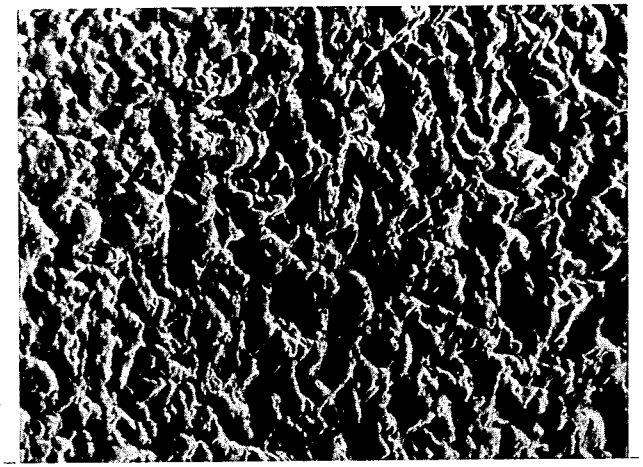
FIG. 9 is a photograph of 50 magnifications showing a reprica of the surface of #800 embossing roll which was used in Examples of the invention taken with an Electron Probe Microanalizer, JXA-50A, manufactured by Japan Electron Optics Laboratory Co., Ltd.
Figure 11:
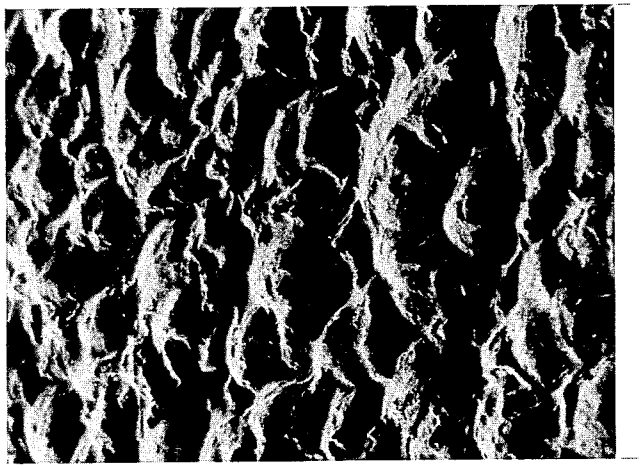
FIG. 11 shows a photograph obtained in the same manner as the above with respect to #300 embossing roll used in examples of the invention.

The properties of the papers obtained in Example 1 and Control 1 are shown in Table 1, FIG. 5 and FIG. 6. The matted transparent paper obtained in Example 1 had a high transparency and a good writability in pencil writing. The misty opaque spot was hardly appreciated. On the contrary, the transparent paper obtained in Control 1 was inferior in a transparency and the surface of the paper was too smooth to give a good writability at a normal writing pressure. In addition, a number of misty opaque spots in the form of wire marks formed on the surface of the base sheet during the paper making process were remarkably appreciated.

EXAMPLE 2

A synthetic pulp ($S_1$) having a CSF of 250 cc was prepared by beating synthetic fibers having 7 denier, a length of 10 mm and a polyvinyl alcohol content of 10% which were obtained by wet spinning from a mixture of a polyvinyl alcohol (hereinafter referred to as PVA). acrylonitrile (hereinafter referred to as AN) graft copolymer in which a weight ratio of PVA/AN was 50/50 with an acrylonitril-styrene copolymer in which a weight ratio of AN/styrene was 24/76. Thus obtained synthetic pulp ($S_1$), a bleached needle-leaved kraft pulp (N) having a CSF of 380 cc and a bleached broad-leaved kraft pulp (L) having a CSF of 450 cc (both used in Example 1) were mixed in the proportions shown in Table 2 and formed into papers in the same manner as in Example 1.

The moisture contents of the resultant papers were adjusted at 22% and then the papers were passed through the same super calender as in Example 1 in the same manner as in Example 1 except that the velocity of passing paper was 80 m/min to obtain matted transparent papers. The properties of the resultant matted transparent papers are shown in Table 2. The matted transparent papers obtained in Example 2 were superior in transparency, writability in pencil writing, dimensional stability, paper strength and appearance.

EXAMPLE 3

The same synthetic pulp ($S_1$) as used in Example 2, a bleached needle-leaved kraft pulp ($N_1$) having a CSF of 580 cc and a bleached broad-leaved kraft pulp ($L_1$) having a CSF of 620 cc were mixed in the ratio shown in Table 3 and formed into papers with a commercial paper machine. The moisture content of the resultant paper was adjusted at the value shown in Table 3.

Figure 14:
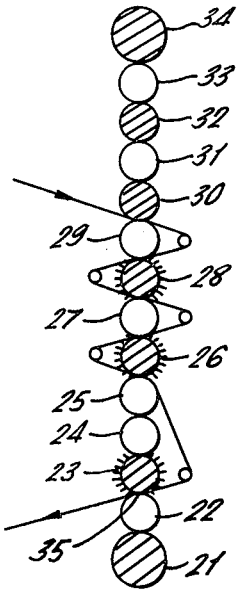
FIG. 14 is a schematic elevational view of a super calender used in Example 3.

Then the sheet was passed through a fourteen stacks super calender in such a manner as shown in FIG. 14 so that one side surface of the paper might be subjected to the treatment with the embossing roll for four times and the reverse side surface of the paper might be subjected to the treatment with the embossing roll for one time.

In FIG. 14 the fourteen stacks super calender is the same one as in Example 1 except that the chilled roll having a smooth surface at the 8th position from the bottom was further replaced with an embossing roll (28') plated with hard chromium and having an engaved surface whose Rmax was 53.7 microns and the relief peak number was 4 per 1 mm (hereinafter referred to as #400 embossing roll). The above treatment was carried out under the conditions that the highest temperature of the embossing roll was at 150° C., the maximum linear pressure of the final nip (35) was 240 kg/cm and the velocity of passing paper was 65 m/min. The properties of the resultant matted transparent papers are shown in Table 3.

Control 2

Two kinds of moistened papers of Example 3-1 and 3-3 were subjected to the same treatment as in Example 3 except that the #400 embossing roll at the 8th position and the #800 embossing roll at the 6th position were replaced with two chilled rolls having smooth surfaces, respectively, and that the #800 embossing roll at the third position was further replaced with a 46 mesh emery sand blast roll plated with hard chromium and having a surface whose Rmax of 11 microns and the relief peak number of 8 per 1 mm to obtain two kinds of transparent papers of Control 2-1 and 2-2, respectively. In this Control, only one side surface of the paper was treated with the 46 mesh emery sand blast roll. The properties of the thus obtained transparent papers are shown in Table 4. The transparent papers obtained in Control 2 were inferior to those obtained in Example 3 in the respects of a transparency and a writability in pencil writing. In addition, a number of misty opaque spots were appreciated.

EXAMPLE 4

A fibrous material ($S_2$) having a CSF of 280 cc was prepared by beating the commercially available synthetic pulp prepared from poly α-olefin (SWP: Product of Mitsui Zellerbach Co., Ltd.) with use of a Sprout-Waldron type single disk refiner under the conditions of the concentration of pulp at 3% and the clearance at 50 microns. Thus obtained fibrous material ($S_2$), a bleached needle-leaved kraft pulp ($N_2$) having a CSF of 450 cc and a bleached broad-leaved kraft pulp ($L_2$) having a CSF of 500 cc were mixed in the ratio shown in Table 5 and formed into a paper with a manual paper-making sheet machine manufactured by Toyo Seiki Co., Ltd.

The moisture content of the resultant sheet was adjusted at the value shown in Table 5. Then, the sheet was passed through a two stack test embossing machine manufactured by Yuri Roll Co., Ltd. which was provided with #800' embossing roll of smaller diameter than that of the #800 embossing roll used in the above Examples having the same engraved patterns as those of the above described #800 embossing roll and provided with an elastic roll under the conditions of the surface temperature of #800' embossing roll at 150° C. and the linear pressure at 200 kg/cm for four times in all, reversing the sheet upside-down.

Control 3

The same treatment as in Example 4 was repeated with use of the same moistened sheet as in Example 4-2 except that the #800' embossing roll was replaced with a 46 mesh emery sand blast roll.

In Example 4, there was no trouble during the process of the treatment and the obtained transparent papers were superior in transparency, writability and appearance.

On the contrary, it was observed in Control 3 that the blisters were produced during the first treating process in which the paper had a high moisture content, owing to the so much minutely uneven surface of 46 mesh sand blast roll. The surface of the transparent paper obtained in Control 3 was not sufficiently matted and accordingly a good writability could not be attained. In addition, a large number of misty opaque spots were appreciated.

EXAMPLE 5

Synthetic pulp ($S_3$) having a CSF of 350 cc was prepared by beating synthetic fibers having a PVA content of 20%, 1.2 denier and a length of 6 mm which were made by a wet spinning process from a mixture of a PVA-AN graft copolymer in which the weight ratio of PVA/AN was 50/50 with an AN-methyl acrylate copolymer comprising 95 mol% of AN and 5 mol% of methyl acrylate.

The bleached needle-leaved kraft pulp ($N_2$) having a CSF of 450 cc and the bleached broad-leaved kraft pulp ($L_2$) having a CSF of 500 cc used in Example 4 were mixed with the above obtained synthetic pulp ($S_3$) in the proportions shown in Table 6 and formed into papers by the same manual paper-making sheet machine as used in Example 4. The moisture content of the obtained papers was adjusted at the value shown in Table 6. Then, the papers were passed through a two stack test embossing machine (manufactured by Yuri Roll Co., Ltd.) provided with the #400 embossing roll and an elastic roll under the conditions of the temperature of the embossing roll at 160° C. and the linear pressure at 220 kg/cm for two times in all, reversing the paper upside-down. The properties of the obtained matted transparent papers are shown in Table 6.

Control 4

Hand-made papers were prepared from the bleached needle-leaved kraft pulp ($N_3$) having a CSF of 55 cc under the conditions shown in Table 7 by the same manual paper-making sheet machine as used in Example 4. The moisture contents of the obtained hand-made papers were adjusted at the values shown in Table 7. Then, each paper was passed through a two stack test embossing machine (manufactured by Yuri Roll Co., Ltd.) provided with a 46 mesh emery sand blast roll and an elastic roll, in which each sheet of Control 4-1, 4-2 and 4-3 was passed for one time, two times reversing the paper upside-down and four times also reversing it upside-down, respectively. The properties of the thus obtained transparent papers are shown in Table 7. The transparent papers obtained in Control 4 were inferior in the respect of the roughness of the paper surface and the dimensional stability.

EXAMPLE 6

Two kinds of commercially available polyvinyl alcohol fibers, VPB 105-1 and VPB 103 (products of Kuraray Co., Ltd.), having one denier and a length of 3 mm were mixed together with in the mixture ratio of VPB 105-1/VPB 103 being 60/40 and then the resultant mixture was dispersed in water to obtain a dispersion of synthetic fibers ($S_4$). Separately, a film of 0.015 mm thickness was prepared by extruding resin pellets consisting of 100 parts of isotactic polypropylene and 30 parts of ethylene-vinyl acetate copolymer and streching the pellets. The obtained film was cut into 10 mm length and then beaten to obtain a synthetic pulp ($S_5$) having a CSF of 680 cc. The thus obtained synthetic pulp ($S_4$) and ($S_5$), the bleached needle-leaved kraft pulp ($N_2$) having a CSF of 450 cc and the bleached broad-leaved kraft pulp ($L_2$) having a CSF of 500 cc were mixed in the proportions shown in Table 8 and then formed into papers with use of a 80 mesh wire. The moisture contents of the sheets obtained in Example 6-1 and 6-2 were adjusted at the values shown in Table 8. Then, each paper was passed through a two stack test embossing machine (manufactured by Yuri Roll Co., Ltd.) provided with an embossing roll having a surface engraved so as to have Rmax of 151 microns and the relief peak number of 2 per 1 mm (#300 embossing roll) and an elastic roll under the conditions of a temperature at 145° C. and a linear pressure at 220 kg/cm for two times in all, reversing the sheet upside-down. Thereafter, the paper was moistened once again so that the moisture content of the paper might be at the value shown in Table 8 and then passed through the above embossing machine under the conditions of a temperature at 150° C. and a linear pressure at 220 kg/cm for four times in all, reversing the paper upside-down.

The procedures for the treatment of the papers obtained in Example 6-3 and 6-4 were similar to that of Example 6-1 except that an embossing roll having a Rmax of 25.8 microns and the relief peak number of 13 per 1 mm was used instead of the #300 embossing roll. The properties of the obtained matted transparent papers are shown in Table 8.

Table 1

| | Example-1 | | | | | | | | | | | | |
|---|---|---|---|---|---|---|---|---|---|---|---|---|---|
| | Sheet forming | | | | | Moisture content after moistening % (on wet basis) | Properties of transparent paper | | | | | | |
| | Pulp composition on dry basis | | | CSF of mixed pulp cc | Weight of sheet g/m² | | Bulk density g/cm³ | Transparency % | Specific tear factor MD/CD | Expansion in water CD % | Surface roughness Rmax μ | Pencil writability | Misty opaque spots |
| | N % | L % | S % | | | | | | | | | | |
| Example-1 | 20 | 80 | — | 400 | 40 | 23 | 1.05 | 62 | 45/39 | 2.40 | 11 | good | hardly appreciated |
| Control-1 | 20 | 80 | — | 400 | 40 | 23 | 1.05 | 55 | 42/38 | 2.20 | 1 | no | many |

Table 1-continued

| | Example-1 | | | | | | | | | | | | |
|---|---|---|---|---|---|---|---|---|---|---|---|---|---|
| | Sheet forming | | | | | Properties of transparent paper | | | | | | | |
| | Pulp composition on dry basis | | | CSF of mixed pulp cc | Weight of sheet g/m² | Moisture content after moistening % (on wet basis) | Bulk density g/cm³ | Transparency % | Specific tear factor MD/CD | Expansion in water CD % | Surface roughness Rmax μ | Pencil writability | Misty opaque spots |
| | N % | L % | S % | | | | | | | | | | |
| | | | | | | | | | | | | good | |

Note:
1 Transparency (%) = 100 − value of opacity by Hunter reflectometer (JIS P-8138).
2 Tear factor was determined according to JIS P-8116.
3 Expansion in water was measured with a Fenchel expansion meter after dipping the sheet in water at 20° C. for 5 minutes.

The above notes are applicable throughout all the Table 1 to 8.

Table 2

| | Example 2 | | | | | | | | | | | | |
|---|---|---|---|---|---|---|---|---|---|---|---|---|---|
| | Sheet forming | | | | | Properties of transparent paper | | | | | | | |
| | Pulp composition on dry basis | | | CSF of mixed pulp cc | Weight of sheet g/m² | Moisture content after moistening % (on wet basis) | Bulk density g/cm³ | Transparency % | Specific tear factor MD/CD | Expansion in water CD % | Surface roughness Rmax μ | Pencil writability | Misty opaque spots |
| | N % | L % | S % | | | | | | | | | | |
| Example 2-1 | 17.5 | 75 | 7.5 | 390 | 40 | 22 | 1.05 | 68 | 42/39 | 1.95 | 13 | good | very few |
| Example 2-2 | 40 | 45 | 15 | 320 | 40 | 22 | 1.05 | 72 | 42/40 | 1.77 | 16 | good | very few |
| Example 2-3 | 30 | 46 | 24 | 310 | 40 | 22 | 1.05 | 74 | 39/37 | 1.48 | 18 | good | very few |

Table 3

| | Example 3 | | | | | | | | | | | | |
|---|---|---|---|---|---|---|---|---|---|---|---|---|---|
| | Sheet forming | | | | | Properties of transparent paper | | | | | | | |
| | Pulp composition on dry basis | | | CSF of mixed pulp cc | Weight of sheet g/m² | Moisture content after moistening % (on wet basis) | Bulk density g/cm³ | Transparency % | Specific tear factor MD/CD | Expansion in water CD % | Surface roughness Rmax μ | Pencil writability | Misty opaque spots |
| | $N_1$ % | $L_1$ % | $S_1$ % | | | | | | | | | | |
| Example 3-1 | 50 | 35 | 15 | 460 | 60 | 20 | 1.05 | 67 | 42/41 | 1.66 | 16 | good | few |
| Example 3-2 | 15 | 75 | 10 | 500 | 64 | 22 | 1.10 | 65 | 39/38 | 1.70 | 16 | good | few |
| Example 3-3 | 30 | 55 | 15 | 470 | 70 | 23 | 1.05 | 62 | 43/41 | 1.34 | 16 | good | few |
| Example 3-4 | 30 | 30 | 40 | 350 | 60 | 15 | 1.00 | 72 | 35/34 | 1.20 | 17 | good | few |

Table 4

| | Control-2 | | | | | | | | | | | | |
|---|---|---|---|---|---|---|---|---|---|---|---|---|---|
| | Sheet forming | | | | | Properties of transparent paper | | | | | | | |
| | Pulp composition on dry basis | | | CSF of mixed pulp cc | Weight of sheet g/m² | Moisture content after moistening % (on wet basis) | Bulk density g/cm³ | Transparency % | Specific tear factor MD/CD | Expansion in water CD % | Surface roughness Rmax μ | Pencil writability | Misty opaque spots |
| | NBKP % | LBKP % | Synthetic pulp % | | | | | | | | | | |
| Control 2-1 | 50 | 35 | 15 | 460 | 60 | 20 | 1.05 | 62 | 41/41 | 1.60 | 4 | too flat to write | many |
| Control 2~3 | 30 | 55 | 15 | 500 | 70 | 23 | 1.05 | 56 | 43/42 | 1.37 | 4 | too flat to write | many |

Table 5

| | Sheet forming | | | | | Example-4 | | | | | | | |
|---|---|---|---|---|---|---|---|---|---|---|---|---|---|
| | | | | | | | Properties of transparent paper | | | | | | |
| | Pulp composition on dry basis | | | CSF of mixed pulp cc | Weight of sheet g/m² | Moisture content after moistening % (on wet basis) | Bulk density g/cm³ | Transparency % | Specific tear factor MD/CD | Expansion in water CD % | Surface roughness Rmax μ | Pencil writability | Misty opaque spots |
| | $N_2$ % | $L_2$ % | $S_2$ % | | | | | | | | | | |
| Example 4-1 | 20 | 60 | 20 | 415 | 50 | 18 | 1.10 | 58.0 | 40/39 | 1.31 | 17 | good | very few |
| Example 4-2 | 40 | 10 | 50 | 340 | 50 | 15 | 0.98 | 74.3 | 37/37 | 0.75 | 18 | good | very few |
| Example 4-3 | 20 | — | 80 | 290 | 50 | 9 | 0.85 | 77.3 | 34/32 | 0.40 | 21 | good | very few |
| Control-3 | 40 | 10 | 50 | 340 | 50 | 15 | 0.90 | 72.1 | 38/37 | 0.71 | 3 | too flat to write | many |

Table 6

| | Sheet forming | | | | | Example-5 | | | | | | | |
|---|---|---|---|---|---|---|---|---|---|---|---|---|---|
| | | | | | | | Properties of transparent paper | | | | | | |
| | Pulp composition on dry basis | | | CSF of mixed pulp cc | Weight of sheet g/m² | Moisture content after moistening % (on wet basis) | Bulk density g/cm³ | Transparency % | Specific tear factor MD/CD | Expansion in water CD % | Surface roughness Rmax μ | Pencil writability | Misty opaque spots |
| | $N_2$ % | $L_2$ % | $S_3$ % | | | | | | | | | | |
| Example 5-1 | 30 | 30 | 40 | 390 | 60 | 14 | 0.95 | 62.0 | 39/36 | 0.90 | 20 | good | very few |
| Example 5-2 | 20 | — | 80 | 340 | 60 | 10 | 0.88 | 71.4 | 35/35 | 0.52 | 24 | good | very few |

Table 7

| | Sheet forming | | | | | Control-4 | | | | | | | |
|---|---|---|---|---|---|---|---|---|---|---|---|---|---|
| | | | | | | | Properties of transparent paper | | | | | | |
| | Pulp composition on dry basis | | | CSF of mixed pulp cc | Weight of sheet g/m² | Moisture content after moistening % (on wet basis) | Bulk density g/cm³ | Transparency % | Specific tear factor MD/CD | Expansion in water CD % | Surface roughness Rmax μ | Pencil writability | Misty opaque spots |
| | $N_3$ % | LBKP % | Synthetic pulp % | | | | | | | | | | |
| Control 4-1 | 100 | — | — | 50 | 50 | 10 | 0.95 | 53.5 | 42/40 | 4.25 | 8 | too flat to write | relatively few |
| Control 4-2 | 100 | — | — | 50 | 50 | 12 | 1.03 | 58.7 | 38/37 | 4.34 | 4 | too flat to write | relatively few |
| Control 4-3 | 100 | — | — | 50 | 50 | 16 | 1.12 | 60.5 | 33/32 | 4.26 | 3 | too flat to write | relatively few |

Table 8

| | Sheet forming | | | | | Example 6 | | | | | | | | |
|---|---|---|---|---|---|---|---|---|---|---|---|---|---|---|
| | | | | | | | | Properties of transparent paper | | | | | | |
| | Pulp composition on dry basis | | | CSF of mixed pulp cc | Weight of sheet g/m² | Moisture content after first moistening (on wet basis) % | Moisture content after second moistening (on wet basis) % | Bulk density g/cm³ | Transparency % | Specific tear factor | Expansion in water % | Surface roughness Rmax μ | Pencil writability | Misty opaque spots |
| | $N_2$ % | $L_2$ % | $S_4$ or $S_5$ % | | | | | | | | | | | |
| Example 6-1 | 35 | 45 | $S_4$ 20 | 520 | 50 | 17 | 14 | 1.12 | 66 | 43 | 0.81 | 12 | good | few |
| Example 6-2 | 35 | 25 | $S_4$ 40 | 565 | 50 | 16 | 13 | 1.10 | 73 | 38 | 0.52 | 13 | good | few |
| Example 6-3 | 35 | 45 | $S_5$ 20 | 515 | 50 | 17 | 14 | 1.13 | 65 | 42 | 0.76 | 13 | good | few |

Table 8-continued

| | Sheet forming | | | | | Example 6 | | | | | | | | |
|---|---|---|---|---|---|---|---|---|---|---|---|---|---|---|
| | | | | | | | | Properties of transparent paper | | | | | | |
| | Pulp composition on dry basis | | | CSF of mixed pulp cc | Weight of sheet g/m² | Moisture content after first moistening (on wet basis) % | Moisture content after second moistening (on wet basis) % | Bulk density g/cm³ | Transparency % | Specific tear factor | Expansion in water % | Surface roughness Rmax μ | Pencil writability | Misty opaque spots |
| | $N_2$ % | $L_2$ % | $S_4$ or $S_5$ % | | | | | | | | | | | |
| Example 6-4 | 35 | 25 | $S_5$ 40 | 545 | 50 | 15 | 14 | 1.07 | 69 | 37 | 0.50 | 14 | good | few |

What we claim is:

1. A method for the production of a matted transparent paper comprising the steps of preparing a paper from an aqueous suspension of natural pulp having a CSF larger than 100 cc, moistening said paper so as to have a moisture content within the range of 5 to 30%, and calendering said moistened paper with the use of a heated embossing metal roll having a surface temperature of 50° to 200° C. to transparentize said moistened paper and form a finely embossed surface thereon, said embossing metal roll having a peripheral surface engraved so as to have a surface roughness of a Rmax of 25 to 160 microns and a relief peak number of 1 to 20 per 1 mm.

2. A method for the production of a matted transparent paper as defined in claim 1, wherein said pulp has a CSF within the range of 150 to 650 cc.

3. A method for the production of a matted transparent paper as defined in claim 2, wherein said pulp has a CSF within the range of 200 to 600 cc.

4. A method for the production of a matted transparent paper as defined in claim 1, wherein said paper is moistened so as to have a moisture content within the range of 7 to 27%.

5. A method for the production of a matted transparent paper as defined in claim 1, wherein said relief peak number is within the range of 2 to 15 per 1 mm.

6. A method for the production of a matted transparent paper as defined in claim 1, wherein said moistened paper is calendered under pressure within the range of 20 to 600 kg/cm.

7. A method for the production of a matted transparent paper as defined in claim 6, wherein said moistened paper is calendered under pressure within the range of 40 to 400 kg/cm.

8. A method for the production of a matted transparent paper as defined in claim 1, wherein the surface temperature of said embossing metal roll is within the range of 80° to 180° C.

* * * * *